US006448931B1

(12) United States Patent
Deguchi et al.

(10) Patent No.: US 6,448,931 B1
(45) Date of Patent: Sep. 10, 2002

(54) ANTENNA

(75) Inventors: Futoshi Deguchi; Toshinori Komesu; Masaya Hamasaki, all of Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/722,209

(22) Filed: Nov. 27, 2000

(30) Foreign Application Priority Data

Dec. 1, 1999 (JP) ..... 11-341767

(51) Int. Cl.[7] ..... H01Q 1/38
(52) U.S. Cl. ..... 343/700 MS; 343/702
(58) Field of Search ..... 343/700 MS, 702, 343/846, 767, 770, 818

(56) References Cited

U.S. PATENT DOCUMENTS 5,627,550 A * 5/1997 Sanad ..... 343/700 MS
5,966,097 A * 10/1999 Fukasawa et al. ... 373/700 MS
5,977,916 A * 11/1999 Vannatta et al. ..... 373/702
6,114,996 A * 9/2000 Nghiem ..... 373/700 MS

FOREIGN PATENT DOCUMENTS

JP 06-334420 12/1994
JP 08-78943 3/1996
JP 10-93332 4/2000

* cited by examiner

*Primary Examiner*—Don Wong
*Assistant Examiner*—James Clinger
(74) *Attorney, Agent, or Firm*—Wenderoth, Lind & Ponack, L.L.P.

(57) ABSTRACT

An antenna includes a grounding plate and a plurality of radiator elements in rectangular shape. The elements are disposed on the grounding plate with its one end being electrically coupled to the grounding plate. Longitudinal lengths of the elements are set within a range of λ/8–3λ/8 so that working frequencies are adjusted at given frequencies. Accordingly, this one antenna can transmit and receive frequencies in a desired frequency band. A coupler is disposed between the plurality of elements, and only one element is fed with power, while the other elements are fed indirectly, so that numbers of feeding points and feed lines are reduced. Further, a distance between the grounding plate and the elements is adjusted to a 0.5–3 inch range, whereby a thin and low antenna is obtainable.

17 Claims, 20 Drawing Sheets

ANTENNA

FIELD OF THE INVENTION

The present invention relates to an antenna formed by integrating a plurality of radiating elements on a board and for transmitting/receiving a plurality of frequencies.

BACKGROUND OF THE INVENTION

Recently, mobile-satellite communications such as between mobile bodies including airplanes, vessels, or cars and satellites have been prevailing. Highly-efficient antennas mounted to the mobile bodies are developed by studying a shape of radiator elements of the antennas to be small in size. This study produces a meander-line antenna or a plate-type inverse F antenna. For instance, Japanese Patent Application Non-examined Publication No. H06-90108 discloses one of the products.

FIG. 15 illustrates a conventional antenna, and FIG. 16 illustrates that the antenna is mounted to a mobile body. FIG. 17 shows a relation between return losses and frequencies. In FIG. 15, antenna 200 comprises the following elements:

(a) Insulation board 200;

(b) Radiator element 201 and formed by meander-line of length L and width W disposed on insulation board 200;

(c) Feed line 202; and (d) Feeding point 203 disposed near the center of element 201.

The frequency characteristic of antenna 200, as shown in FIG. 17, has a single resonance frequency $f_0$, and frequency $f_0$ is determined mainly by element's length L. The frequency relative bandwidth of antenna 200 is about several percent.

FIG. 18 shows another conventional antenna, which includes two independent antenna sections 210 and 220 having different resonance frequencies. Antenna section 210 comprises radiator element 211, short-circuiting plate 212, feeding section 213, and grounding plate 214. Radiator 211 shapes in a long and narrow rectangular plate, and short-circuiting plate 212 couples electrically radiator element 211 with grounding plate 214. Feeding section 213 is disposed at a side end of element 211 as shown in FIG. 18. Antenna section 210 has a resonance frequency $f_1$ determined by the sum (L1+H1) of length L1 of element 211 and the height H1 of short-circuiting plate 212. Antenna section 220 is structured in the same way and has resonance frequency $f_2$ determined by the sum (L2+H2) of length L2 of element 221 and the height H2 of short-circuiting plate 222. The frequency relative bandwidth of this antenna is also several percent, and if the radiator element is shortened for downsizing the antenna, the relative bandwidth further narrows.

In general, as discussed above, the conventional antenna has a narrow frequency relative bandwidth. Therefore, when a transmitting band and a receiving band are greater than the relative bandwidth, an antenna including two sections, one for transmitting and the other for receiving, is required. For example, in the mobile satellite communication system (ORBCOMM system) assigned by World Administrative Radio Conference 1992, where several dozens of low-earth-orbital satellites perform data communication between the ground and the satellites, frequencies for uplink/downlink (137.0–138.0 MHz/148.0–150.05 MHz) are used. Also, a conventional antenna cannot cover these two frequency-bands, therefore, an antenna including two sections, one for transmitting and the other for receiving is required.

When antennas independently dedicated to transmitting and receiving are used, these antennas should be separately mounted to a mobile body, such as a car or a container. Accordingly, two feeding points and two feed lines are required, and wiring job should be doubled, which makes a mounting job very complicated. The conventional antenna is ca. 0.5 m tall, when this is mounted to a container, it is hard to put the antenna into a clearance between the containers. Further, when the antenna is mounted vertically to a car, the antenna is vulnerable to damaged caused by wind pressure or interference with other members. When the antenna is mounted horizontally to a car, the metal sheet of the car influences the antenna so that an antenna impedance changes, its resonance frequency shifts, or impedance matching between the antenna and its feeding line is disordered, thereby the antenna does not work properly.

SUMMARY OF THE INVENTION

An antenna being capable of transmitting and receiving a plurality of frequencies is provided. This antenna is small, thin, and easy-to-mount. The antenna is also characterized by high production-efficiency.

This antenna comprises a ground plate and a plurality of radiator elements shaping with a rectangular shape, where a first end of the antenna is short-circuited to the grounding plate, the elements which are disposed separately from the ground plate. The longitudinal lengths of the elements are set within the range of $\lambda/8$–$3\lambda/8$ so that a working frequency of respective elements meet given frequencies. One single antenna thus can transmit and receive frequencies within a desired frequency bandwidth. Further, couplers between a plurality of elements are provided so that only one radiator element can be fed power, and the other elements are fed indirectly. This structure allows a number of feeding points and feed lines to be reduced.

DETAILED DESCRIPTION OF THE PREFERRED EMBODIMENTS

Exemplary Embodiment 1

Figure 1A:
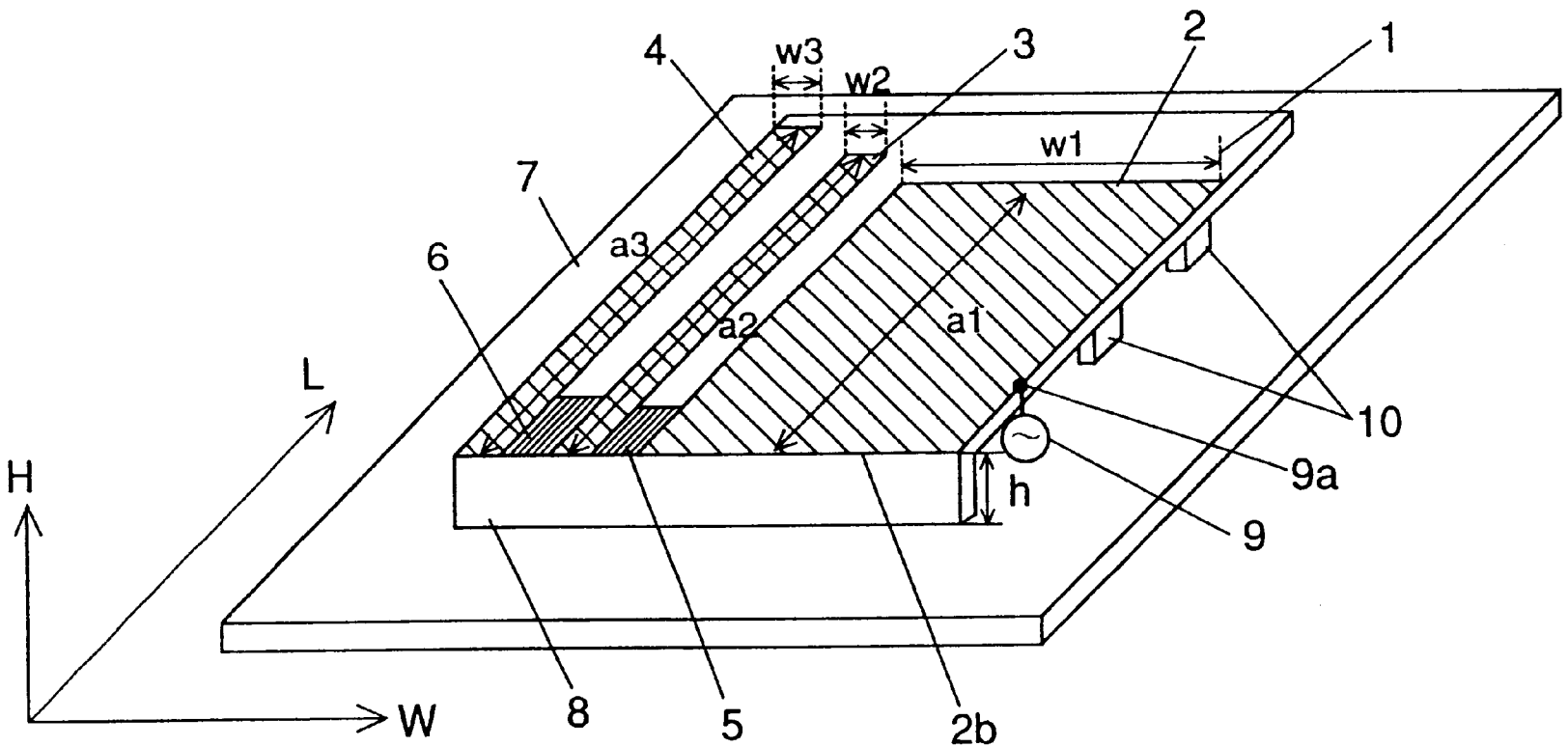
FIG. 1A is a perspective view of an antenna in accordance with a first exemplary embodiment of the present invention.
Figure 1B:
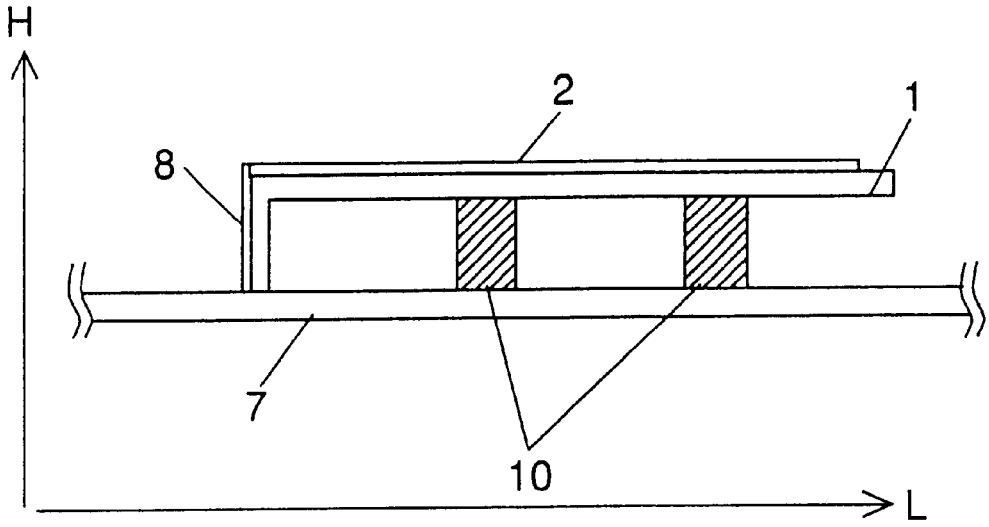
FIG. 1B is a lateral cross section of the antenna in accordance with the firsts exemplary embodiment of the present invention.

FIG. 1A is a perspective view of an antenna in accordance with a first exemplary embodiment of the present invention. FIG. 1B is a lateral cross section of the same antenna. The major components and characteristics of the antenna will be described hereinafter.

Antenna board 1 is made of mainly dielectric material, and the board has a conductive layer on a face or on both the faces. The board is formed of a printed board or a polyethylene terephthalate (PET) film board. The relative dielectric constant of the dielectric material ranges from 2.5 to 10, and using material of the higher dielectric constant achieves the smaller antenna. In the first embodiment, rather inexpensive glass epoxy of which relative dielectric constant is about 4.6 is employed.

Radiator elements 2, 3 and 4 are formed by etching copper foil on the single face or on both the faces of antenna board 1. The radiator elements can be also formed by bonding, printing, spattering or through photo-lithography besides the etching. Besides the copper, iron, aluminum, stainless steel, or plated steel can be employed as material. In this embodiment, one radiator element corresponds to one frequency in order to transmit/receive a plurality of frequencies. Radiator elements 4, 3 and 2 correspond to lower to higher frequencies in this order, i.e. longer to shorter wavelength, and guide-wavelength $\lambda g3$, $\lambda g2$, $\lambda g1$ correspond to elements 4, 3, 2 respectively, where $\lambda g3>\lambda g2>\lambda g1$. It is desirable that the thickness of conductor forming radiator elements 2, 3, 4 ranges from 18 $\mu$m to 3 mm, because this thickness realizes resonance in plural elements and substantial strength of the elements. Being less than 18 $\mu$m, the thickness is smaller than the skin-depth of the conductor. Also, when the thickness is more than 3 mm, radiator elements 2, 3, 4, and in particular narrow elements 3, 4 are vulnerable to coming off antenna board 1 because the bonding strength to board 1 is lowered. When the antenna is used in a VHF band or a UHF band, the thickness-range discussed above produces the best characteristics and stable strength. If the range is further narrowed to 35 $\mu$m–2 mm, any one of elements 2, 3, 4 having different dimensions can obtain excellent resonance characteristics and mechanical strength. As a result, an antenna having excellent plural resonance characteristics can be achieved. It is preferable that a clearance between elements 2 and 3 ranges from 10 mm to 40 mm because coupled power can be optimized.

In this embodiment, three elements are used; however, four or more elements can be employed.

Coupler 5 couples element 3 with element 2 electrically, and coupler 6 couples element 3 with element 4 electrically. These couplers are made of the same material as the radiator elements. Radiator elements 2, 3, 4 and couplers 5, 6 are formed of the same material and the elements are connected to the couplers directly, so that defects due to poor soldering are avoided. Further, this structure reduces bonding processes, thereby increasing the productivity. It is preferable that couplers 5 and 6 have dimensions of 5–10 mm length and 10–50 mm width because coupled power can be optimized. In other words, the power induced from element 2 to element 3 via coupler 5 as well as the power induced from element 3 to element 4 through coupler 6 is optimized. Grounding plate 7 is disposed approximately parallel with elements 2, 3 and 4. This arrangement produces better antenna characteristics, and allows the antenna to be thinner. Grounding plate 7 is made of a metal conductor such as aluminum, stainless steel, or plated steel. Grounding plate 7 can be disposed on the face opposite to the plate face where elements 2, 3 and 4 are formed.

Short-circuiting plate 8 couples elements 2, 3, 4 with grounding plate 7 electrically, and has height of 'h' with respect to both elements 2, 3, 4 and grounding plate 7. Plate 8 can be made of the same material as the radiator elements. In the first embodiment, elements 2, 3 and 4 share one short-circuiting plate 8; however, each element can have plate 8 respectively. It is preferable that antenna board 1 is bent at right angles as shown in FIG. 1B, and elements 2, 3, 4 and short-circuiting 8 are formed of the same conductor because this structure increases the productivity of the antenna as discussed already about the couplers.

If elements 2, 3, 4 are not approximately parallel with grounding plate 7, short-circuiting plate 8 is preferably disposed so that the elements can be coupled to grounding plate 7 at the closest distance. As such, elements 2, 3, 4 are coupled to grounding plate 7 by short-circuiting plate 8, thereby realizing a small antenna. Particularly in a thin antenna, the gain characteristic among antenna characteristics can be better. Further, in the antenna whose thickness is not more than one inch, this structure obtains more than 2 dB in antenna gain.

Feeding section 9 feeds radiator element 2 with high frequency power via transmission line such as a coaxial cable or a microstrip-line. The power is supplied to element 2 through feeding point 9*a* disposed at side end 2*b*. The distance between feeding point 9*a* and side end 2*b* on the side of short-circuiting plate 8 preferably ranges between $\lambda/50$–$\lambda/15$ because of better impedance matching. The current supplied from feeding point 9*a* is guided not only to element 2 but also to elements 3, 4 via couplers 4 and 5. This structure allows the antenna to reduce a number of feeding sections as well as feeding points. As a result, less restriction in designing antennas can be expected. The shapes of couplers 5, 6 are appropriately adjusted so that the current running to elements 3, 4 can be adjusted. A number of feed lines between the outside and the feeding section as well as between the feeding section and the feeding point can be reduced, so that a number of parts can be also reduced. In other words, the antenna can be simplified. Further, a number of feeding sections as well as feeding points can be reduced, whereby jobs accompanying the coupling are also reduced. As a result, the productivity of the antenna increases.

Spacer 10 is made of elastic material such as rubber or resin, and inserted between antenna board 1 and grounding plate 7 as a support member to maintain exactly the height 'h' therebetween. If spacer 10 is disposed close to elements 2, 3 as much as possible on antenna board 1, a change of the dielectric constant between grounding plate 7 and antenna board 1 can be minimized. This change of the dielectric constant influences the antenna characteristics.

Next, the electrical characteristics of the antenna will be described hereinafter. Radiator elements 2, 3, 4 correspond to guide wavelengths λg1, λg2, λg3 of resonance frequencies $f_1$, $f_2$, $f_3$ respectively. Lengths a1, a2, a3 of elements 2, 3, 4 in L direction as well as height 'h' in H direction of short-circuiting plate 8 are key factors for determining resonance frequencies. The lengths (h+a1), (h+a2), (h+a3), i.e., the sum of height 'h' of short-circuiting plate 8 and each length of the elements, namely, guide lengths from the open end of the element to a short-circuit point on grounding plate 7 almost determine resonance frequencies $f_1$, $f_2$, $f_3$. When these values are in the following ranges, the antenna has given resonance frequencies.

| | |
|---|---|
| h: | 0.5–3.0 inch |
| a1, a2, a3: | λ/100–3λ/8 |
| h + a1, h + a2, h + a3: | λ/8–3λ/8 |

If the following relations are satisfied, the antenna can be thinner with excellent characteristics: 0.5 inch ≦h ≦1.0 inch, λ/6≦a1≦λ/3. If the values of (h+a1), (h+a2), (h+a3) are different with each other, the frequency characteristic of the antenna becomes wide-band, and have a plurality of resonance frequencies. As a result, less restriction in designing the antenna can be expected.

If the sum of elements' lengths and the height of short-circuiting plate is about λ/4, the most excellent antenna characteristics can be obtained.

If the width of elements 2, 3, 4, i.e. w1, w2, w3 fall in the range of 0–λ/4, a highly efficient antenna can be obtained.

As discussed above, radiator elements 2, 3, 4, of which working frequencies differ from each other, are mounted on common board 1, so that the antenna is simplified, and the productivity thus increases comparing with the case where respective elements are disposed on independent boards. This antenna can transmit/receive a plurality of frequencies with a small and thin body. In particular, when the sum of element length and the height of the short-circuiting plate falls in a quarter of the corresponding wavelength, the antenna can transmit/receive a radio-wave optimally corresponding to respective wavelengths. As a result, an excellent cross-polarization characteristic of the antenna is obtained.

Exemplary Embodiment 2

Figure 2:
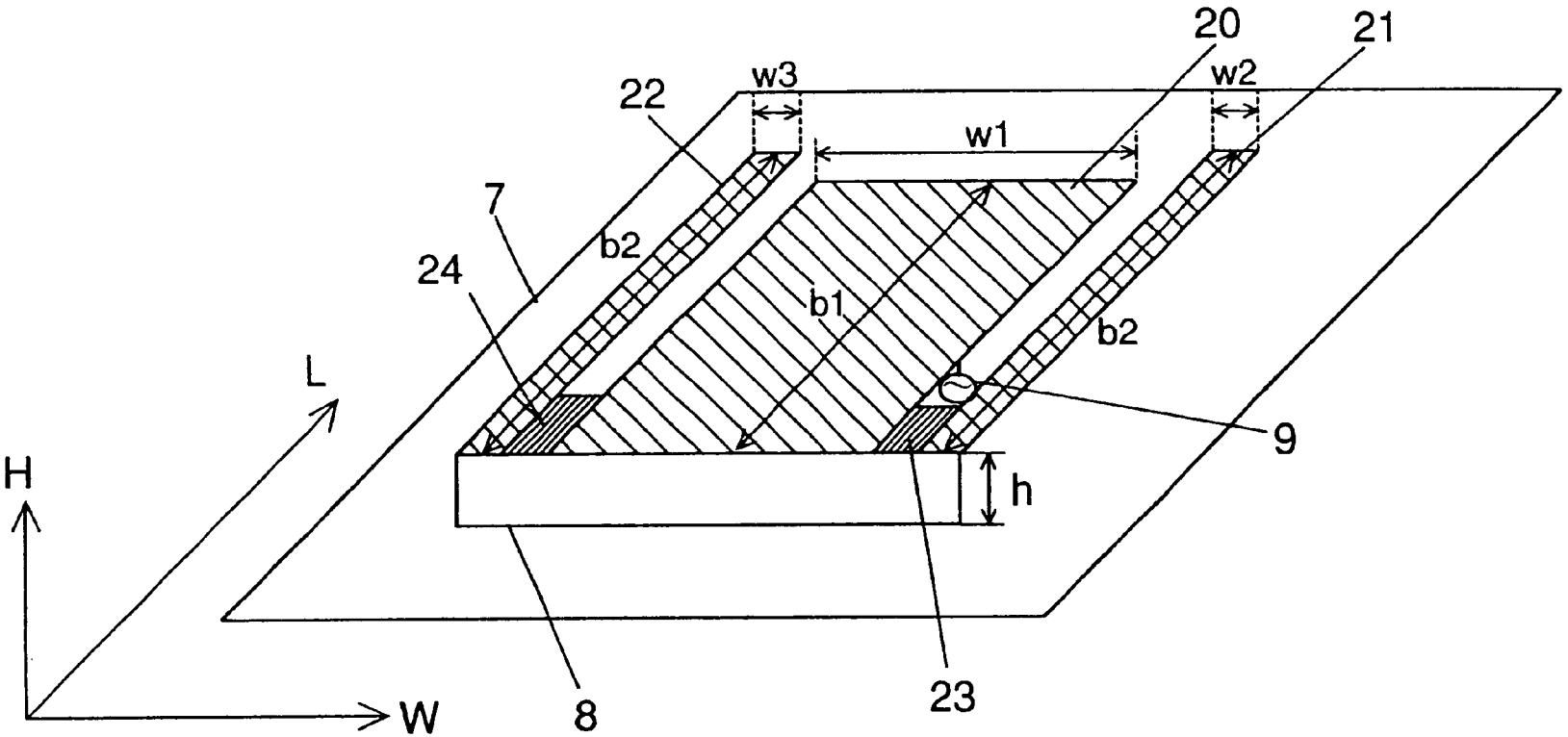
FIG. 2 is a perspective view of an antenna in accordance with a second exemplary embodiment of the present invention.

The second embodiment differs from the first one in arrangement of the radiator elements, and other points remain the same. Thus, only the difference will be described hereinafter. FIG. 2 is a perspective view of the antenna in accordance with the second embodiment. In FIG. 2, radiator elements and couplers are mainly illustrated, and an antenna board or a spacer is not shown. Elements, 20, 21, 22 are made of the same material as elements 2, 3, 4 in the first embodiment, and the thickness of the elements remain the same. In order to transmit/receive a plurality of frequencies, one or more than one elements are provided to one frequency. Element 20 corresponds to high frequency $f_1$, and elements 21, 22 correspond to low frequency $f_2$. In this second embodiment, three elements are prepared; however, a number of elements may be four or more than four.

Coupler 23 couples element 20 with element 21, and coupler 24 couples element 21 with element 22. Coupler's dimension and the way of forming the coupler are the same as those of couplers 5, 6 in the first embodiment.

Next, electrical characteristics of the antenna in accordance with the second exemplary embodiment will be described hereinafter. In FIG. 2, length b1 of element 20 is determined based on guide wavelength λg1 corresponding to resonance frequency $f_1$. Length b2 of elements 21 and 22 are determined based on guide wavelength λg2 corresponding to resonance frequency $f_2$. The relations between elements' lengths b1, b2, elements' widths w1, w2, w3, height 'h' of short-circuiting plate 8 and antenna characteristics remain the same as those in the first embodiment. Determining 'h', b1, b2 at the same values as in the first embodiment produces a highly efficient antenna.

In the second embodiment, widths w2, w3 differ from each other and these value are appropriately adjusted so that antenna's directivity can be controlled. In particular, a symmetric directivity is obtainable when w2=w3 is satisfied. Receiving radiator elements 21 and 22, of which the working frequency is $f_2$, are disposed on both sides of transmitting radiator element 20, so that a number of null-points of the antenna at $f_2$ is reduced. Accordingly, the antenna is hardly subject to influence from the object (e.g. car, container) to which the antenna is mounted, and the antenna with excellent characteristics is thus obtainable.

Exemplary Embodiment 3

Figure 3:
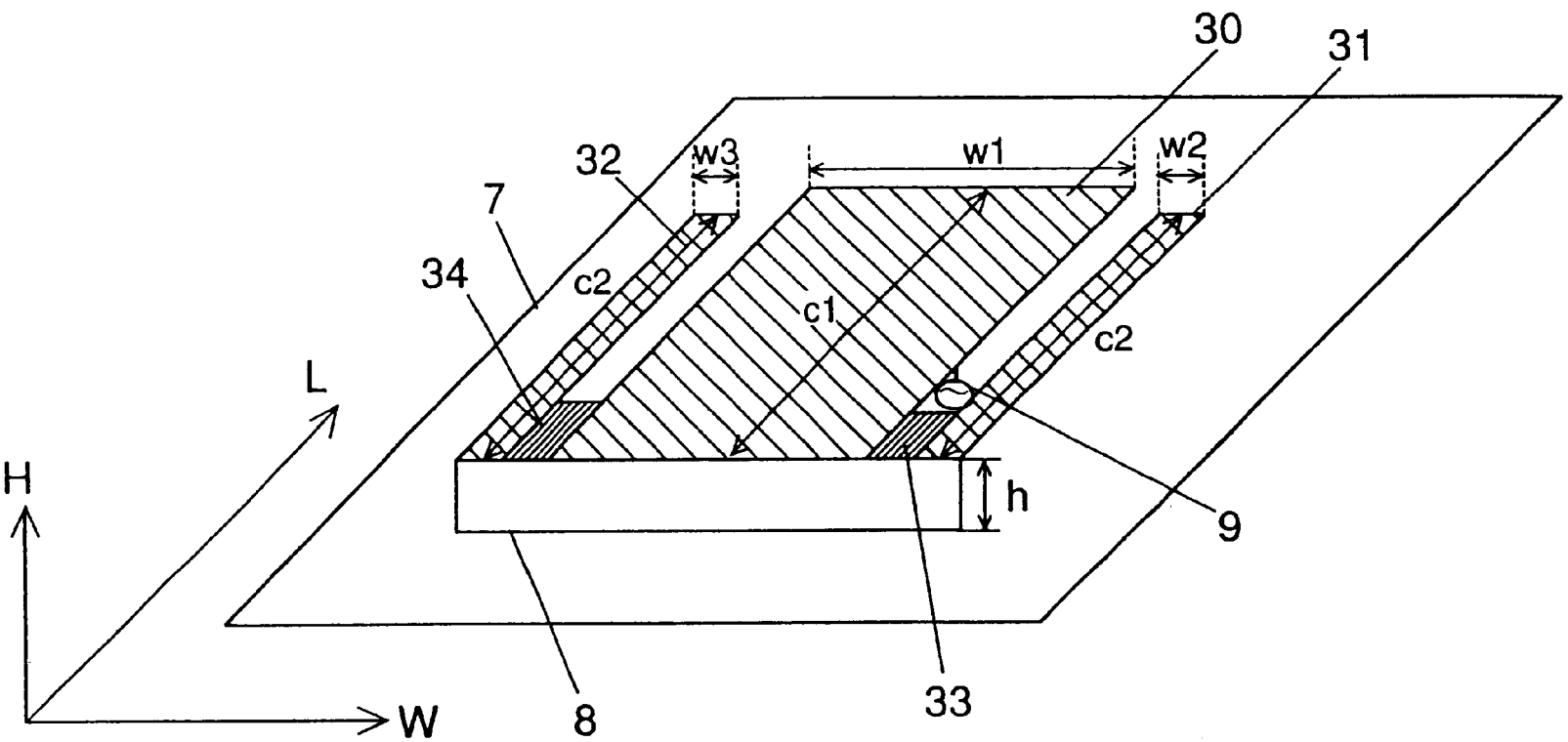
FIG. 3 is a perspective view of an antenna in accordance with a third exemplary embodiment of the present invention.

The third embodiment differs from the first one in an arrangement of the radiator elements, and other points remain the same. Thus, only the difference will be described hereinafter. FIG. 3 is a perspective view of the antenna in accordance with the third embodiment. In FIG. 3, radiator elements and couplers are mainly illustrated, and an antenna board or a spacer is not shown. Elements, 30, 31, 32 are made of the same material as elements 2, 3, 4 in the first embodiment, and the thickness of the elements remain the same.

This third embodiment differs from the second one in the relation between radiator elements and frequencies. In order to transmit/receive a plurality of frequencies, one or more than one elements are provided to one frequency. Element 31 and 32 correspond to high frequency $f_1$, and element 30 corresponds to low frequency $f_2$. As same as the second embodiment, a number of elements may be four or more than four.

Coupler 33 couples element 30 with element 31, and coupler 34 couples element 31 with element 32. Coupler's dimension and the way of forming the coupler are the same as those of couplers 5, 6 in the first embodiment.

Next, electrical characteristics of the antenna in accordance with the third exemplary embodiment will be described hereinafter. In FIG. 3, length c1 of element 30 is determined based on guide wavelength λg1 corresponding to resonance frequency $f_1$. Length c2 of elements 31 and 32 are determined based on guide wavelength λg2 corresponding to resonance frequency $f_2$. The relations between elements' lengths c1, c2, elements' widths w1, w2, w3, height 'h' of short-circuiting plate 8 and antenna characteristics remain the same as those in the second embodiment. Determining 'h', c1, c2 at the same values as in the second embodiment produces a highly efficient antenna.

In the third embodiment, as same as the second embodiment, widths w2, w3 differ from each other and these value are appropriately adjusted so that antenna's directivity can be controlled. In particular, a symmetric directivity is obtainable when w2=w3 is satisfied. Transmitting radiator elements 31 and 32, of which working frequency is $f_1$, are disposed on both sides of receiving radiator element 30, so that a number of null points of the antenna at $f_1$, is reduced. Accordingly, the antenna is hardly subject to influence from the object (e.g. car, container) to which the antenna is mounted, and the antenna with excellent characteristics is thus obtainable.

Exemplary Embodiment 4

Figure 4A:
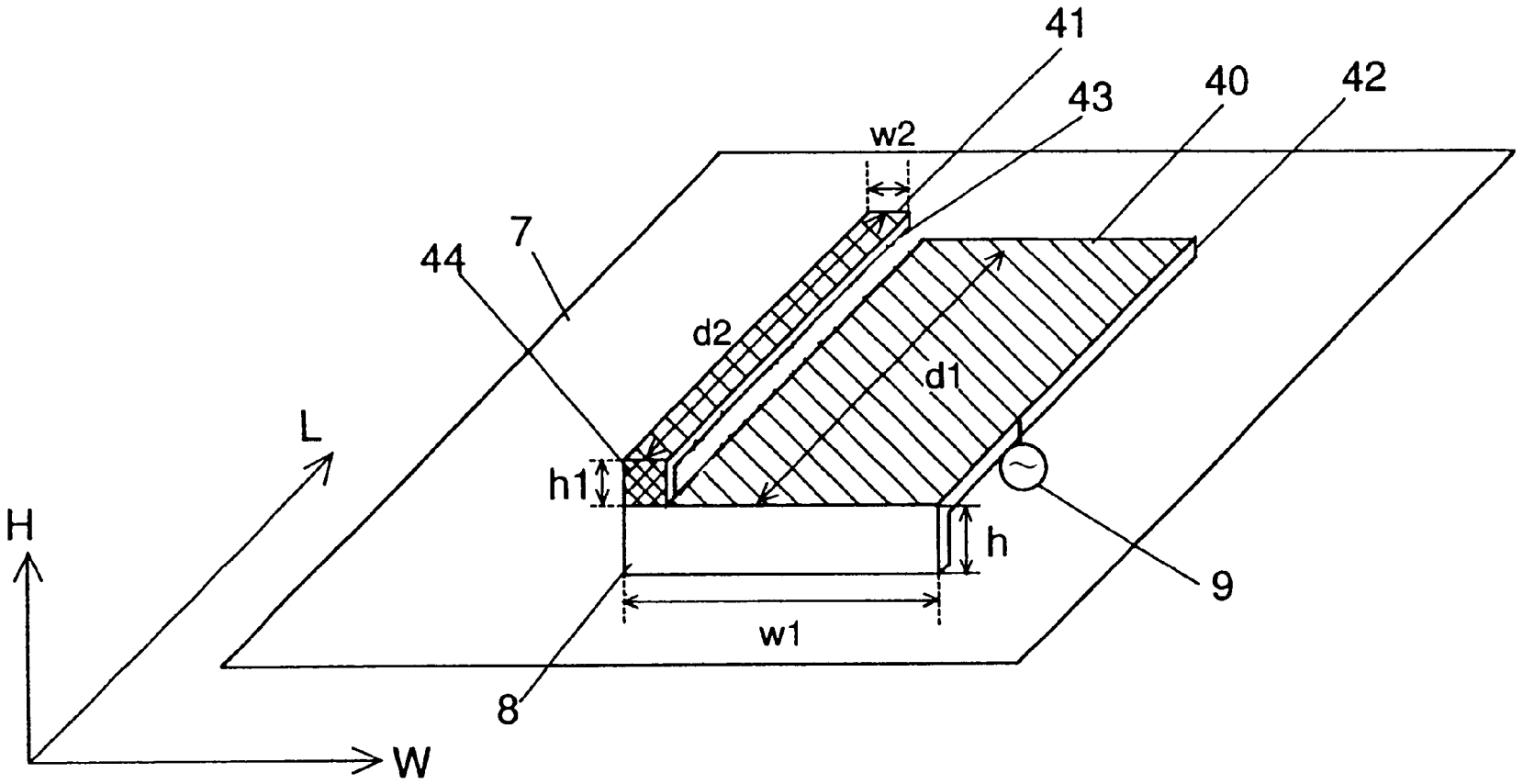
FIG. 4A is a perspective view of an antenna in accordance with a fourth exemplary embodiment of the present invention.
Figure 4B:
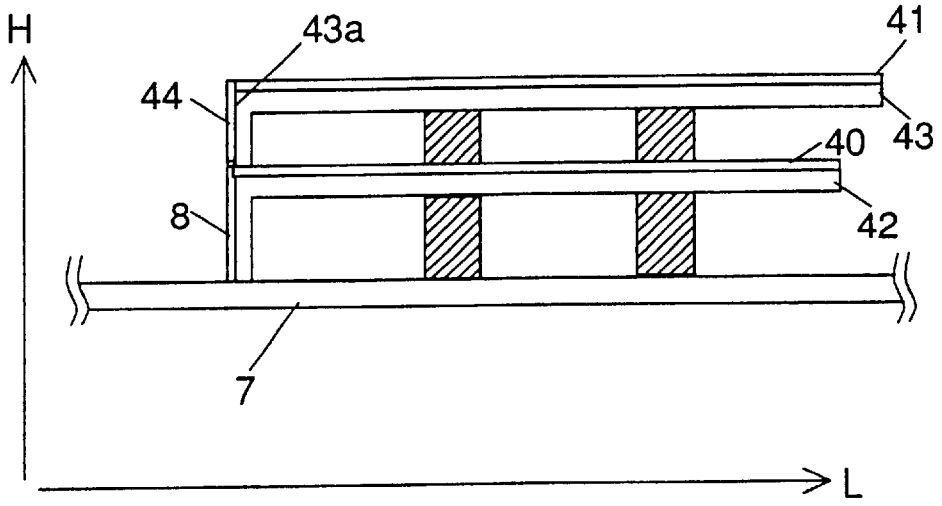
FIG. 4B is a lateral view of the antenna in accordance with the fourth exemplary embodiment of the present invention.

FIG. 4A is a perspective view of an antenna in accordance with the fourth exemplary embodiment, and FIG. 4B is a lateral view of the same antenna. FIG. 4A does not illustrate a spacer.

In the fourth embodiment, radiator elements 40 and 41 are made of the same material as elements 2, 3, and 4 in the first embodiment, and have the same thickness. Radiator element 40 is formed on antenna board 42, and element 41 is formed on antenna board 43. Boards 42 and 43 are made of the same material as antenna board 1 in the first embodiment. Elements 40, 41 are desirably disposed approximately parallel with grounding plate 7 for excellent antenna characteristics.

Coupler 44 couples element 40 or short-circuiting plate 8 with element 41 electrically, therefore coupler 44 is formed on end 43*a* of antenna board 43 in the longitudinal direction. Coupler 44 has a height 'h' of 0.5–3.0 inch so that the antenna can be thin.

In order to transmit/receive a plurality of frequencies, one element is provided to one frequency. Element 40 corresponds to high frequency $f_1$, and element 41 corresponds to low frequency $f_2$. Relation in lengths between elements 40 and 41 can be reversed. Antenna board 43 is placed at a higher place than board 42 by height 'h' of coupler 44 with respect to grounding plate 7 so that the clearance between element 41 and plate 7 becomes greater than the clearance between element 40 and plate 7. Radiator elements 40 and 41, for obtaining two resonance frequencies, are thus laid one on top of the other in the vertical direction. Indeed this structure increases the height; however, it can downsize a space in the horizontal direction.

Next, the electrical characteristics of the antenna will be described hereinafter. In FIG. 4A, lengths d1 and d2 of radiator elements 40 and 41 correspond to guide wavelength λg1, λg2 of resonance frequencies $f_1$, $f_2$, respectively. Length d1 of element 40 as well as height 'h' of short-circuiting plate 8 is key factor for determining the resonance frequency. Resonance frequency f, is almost determined by the length (h+d1), i.e. the sum of height 'h' of short-circuiting plate 8 and the length d1 of element 40. In the same way, resonance frequency $f_2$ ($f_1>f_2$ or $f_1<f_2$) is almost determined by the length of (h+h1+d2), where h=height of short-circuiting plate 8, h1=height of coupler 44, and d2=length of element 41. When these values fall in the following ranges, the antenna has given resonance frequencies $f_1$ and $f_2$.

| | |
|---|---|
| h, h1: | 0.5–3.0 inch |
| d1, d2: | λ/100–3λ/8 |

If the following relations are satisfied, the antenna can be thinner with excellent characteristics: 0.5 inch≦h+h1≦1.0 inch, λ/6≦(d1, d2)≦λ/3.

If the sum of element's length and the height of short-circuiting plate is about λ/4, the most excellent antenna characteristics can be obtained.

If the width of elements 40, 41, i.e., w1, w2 fall in the range of 0–λ/4, a highly efficient antenna can be achieved.

As discussed above, stacking up a plurality of antennas in the height direction produces excellent antenna characteristics, and yet realizes a compact antenna.

Exemplary Embodiment 5

Figure 5:
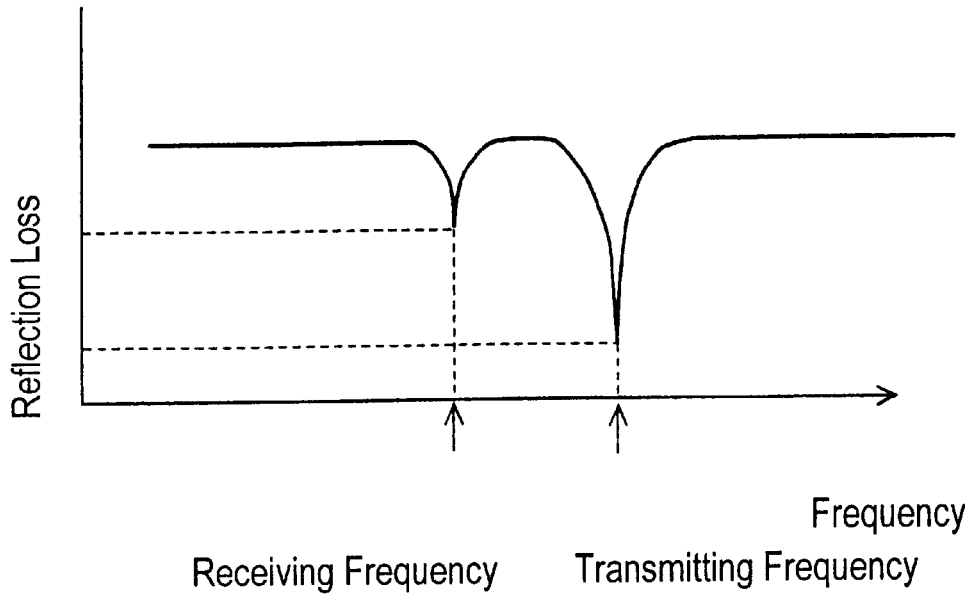
FIG. 5 is a perspective view of an antenna in accordance with a fifth exemplary embodiment of the present invention.

The fifth embodiment differs from the first one in the arrangement of the radiator elements, and other points remain the same. Thus, only the difference will mainly be described hereinafter. FIG. 5 is a perspective view of the antenna in accordance with the fifth embodiment. In FIG. 5, radiator elements and couplers are mainly illustrated, and an antenna board as well as a spacer is not shown. Elements, 50, 51, 52 are made of the same material as elements 2, 3, 4 in the first embodiment, and the thickness of the elements remain the same. In order to transmit/receive a plurality of frequencies, one or more than one elements are provided to one frequency as same as the third embodiment. Element 50 corresponds to high frequency $f_1$, and elements 51, 52 correspond to low frequency $f_2$. In this second embodiment, three elements are prepared; however, a number of elements may be four or more than four.

Coupler 53 couples clement 50 with element 51, and coupler 54 couples element 51 with element 52. Coupler's dimension and the way of forming the coupler are the same as those of couplers 23, 24 in the third embodiment.

Next, electrical characteristics of the antenna in accordance with the fifth exemplary embodiment will be described hereinafter. In FIG. 5, length 'e1' of element 50 is determined based on guide wavelength λg1 corresponding to resonance frequency $f_1$. Length e2 of elements 51 and 52 are determined based on guide wavelength λg2 corresponding to resonance frequency $f_2$. The relations between elements' lengths e1, e2, elements' widths w1, w2, w3, height 'h' of short-circuiting plate 8 and antenna characteristics remain the same as those in the third embodiment. Determining 'h', e1, e2 at the same values as in the first embodiment produces a highly efficient antenna. Widths w2, w3 are appropriately adjusted to control antenna's directivity, whereby symmetrical directivity can be obtained. In the fifth embodiment, as shown in FIG. 5, a slit is provided near the end center on the short-circuiting plate of element 50. The length and width of this slit are e7 and e8, respectively. At the inner section of the slit, feeding section 9 is disposed to feed the elements with power. Slit length e7 preferably ranges from λ/50 to λ/15 for optimizing the impedance matching. Slit length e7 is adjusted appropriately, so that a frequency bandwidth can be set arbitrarily. Further, slit width e8 is adjusted appropriately, so that the frequency bandwidth can be changed arbitrarily. Feeding section 9 is accommodated within element 50, so that a small antenna is obtainable.

Exemplary Embodiment 6

This sixth embodiment is almost as same as the second embodiment except the area ratio of the radiator elements, thus only the different point is described hereinafter.

In FIG. 2, length 'b1' of transmitting radiator element 20, and length 'b2' of receiving radiator elements 21, 22 are set within a range of $\lambda/100$–$3\lambda/8$. In communication systems such as ORBCOMM, when a transmitting antenna differs from a receiving antenna in gain, better characteristics as an entire system can be obtained than the case where there is no difference therebetween. An area of the antenna having a flat face for such a system is set as follows, then the antenna gain at transmitting can be greater than that at receiving: $1/30 \leqq$ (total area of receiving radiator elements 21, 22)/(area of transmitting radiator element 20) $\leqq 1/2$.

Figure 6:
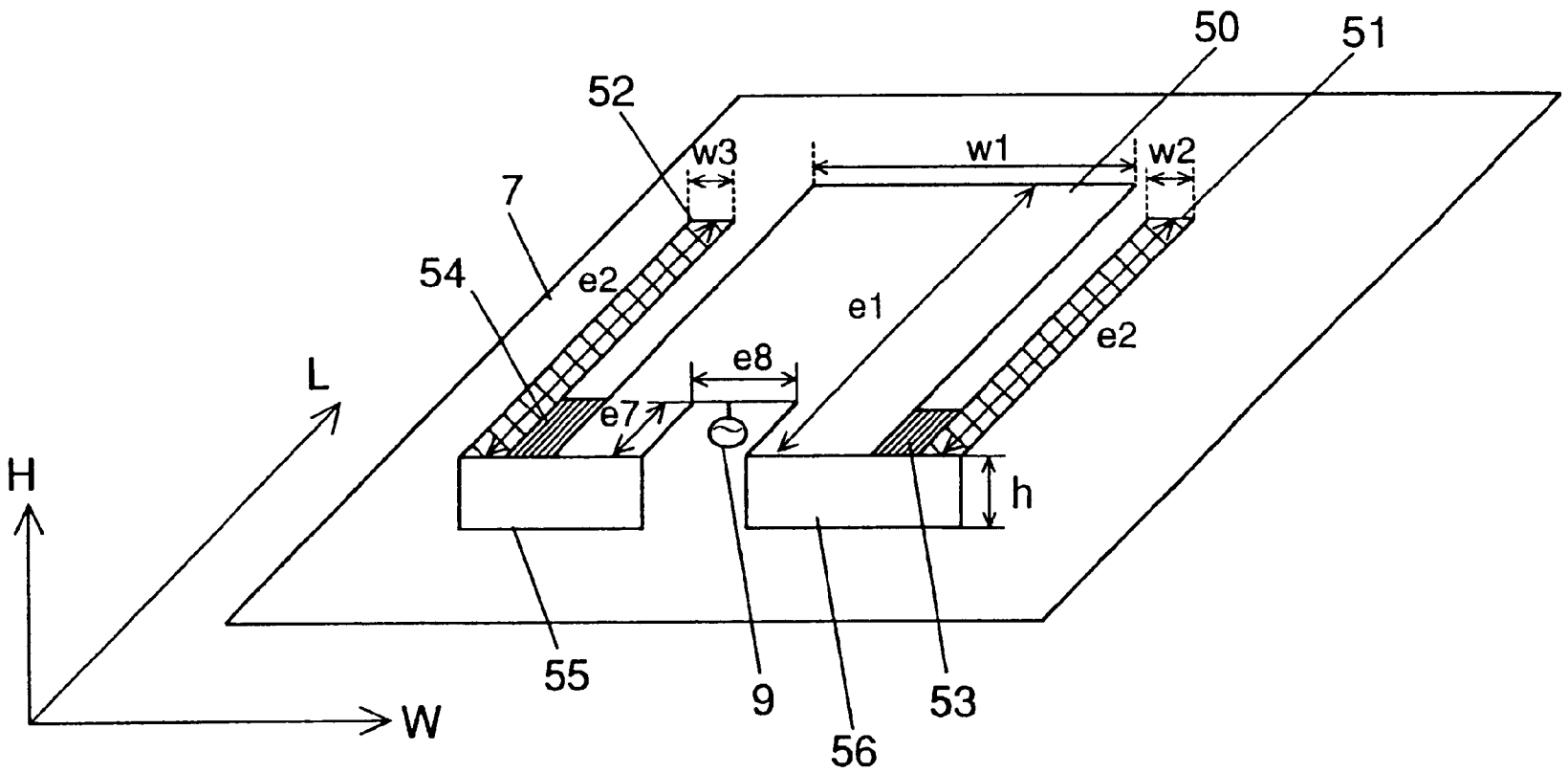
FIG. 6 shows a relation between return losses and frequencies in accordance with a sixth exemplary embodiment of the present invention.

FIG. 6 illustrates a relation between return losses and frequencies when (total area of receiving radiator elements 21, 22)/(area of transmitting radiator element 20)=1/15. In this case, the antenna gain at transmitting is greater than that at receiving by 2–3 dB.

The difference in gain between the transmitting antenna and the receiving antenna allows a net working rate of the communication system with the antennas to increase comparing with a case where there is no difference. As a result, communication errors decrease and stable characteristics are obtainable.

Exemplary Embodiment 7

This seventh exemplary embodiment has the same structure as the second embodiment; however, the seventh embodiment equips couplers 23, 24 with an adjusting function. This different point will be described hereinafter.

In FIG. 2, coupler 23 couples element 20 with element 21 electrically, and coupler 24 couples element 21 with element 22 electrically. The construction, dimensions and method of forming of couplers 23, 24 are the same as those of couplers 5, 6 used in the first embodiment, thus the descriptions thereof are omitted here.

The greater current running through element 20 is induced to element 21 at the longer coupler 23. In this case, the current running through element 21 increases. Thus, the antenna gain of element 21 is high, so that the frequency bandwidth can be widened. The same discussion is applicable to coupler 24. On the other hand, if the width of coupler 23 is widened, a coupling amount decreases, which allows current running through element 21 to decrease. This lowers the antenna gain of element 21, and as a result, the frequency bandwidth can be narrowed. The same discussion is applicable to coupler 24. The seventh embodiment proves that changing the dimensions of the coupler can control the antenna gain as well as frequency bandwidth.

Exemplary Embodiment 8

Figure 7:
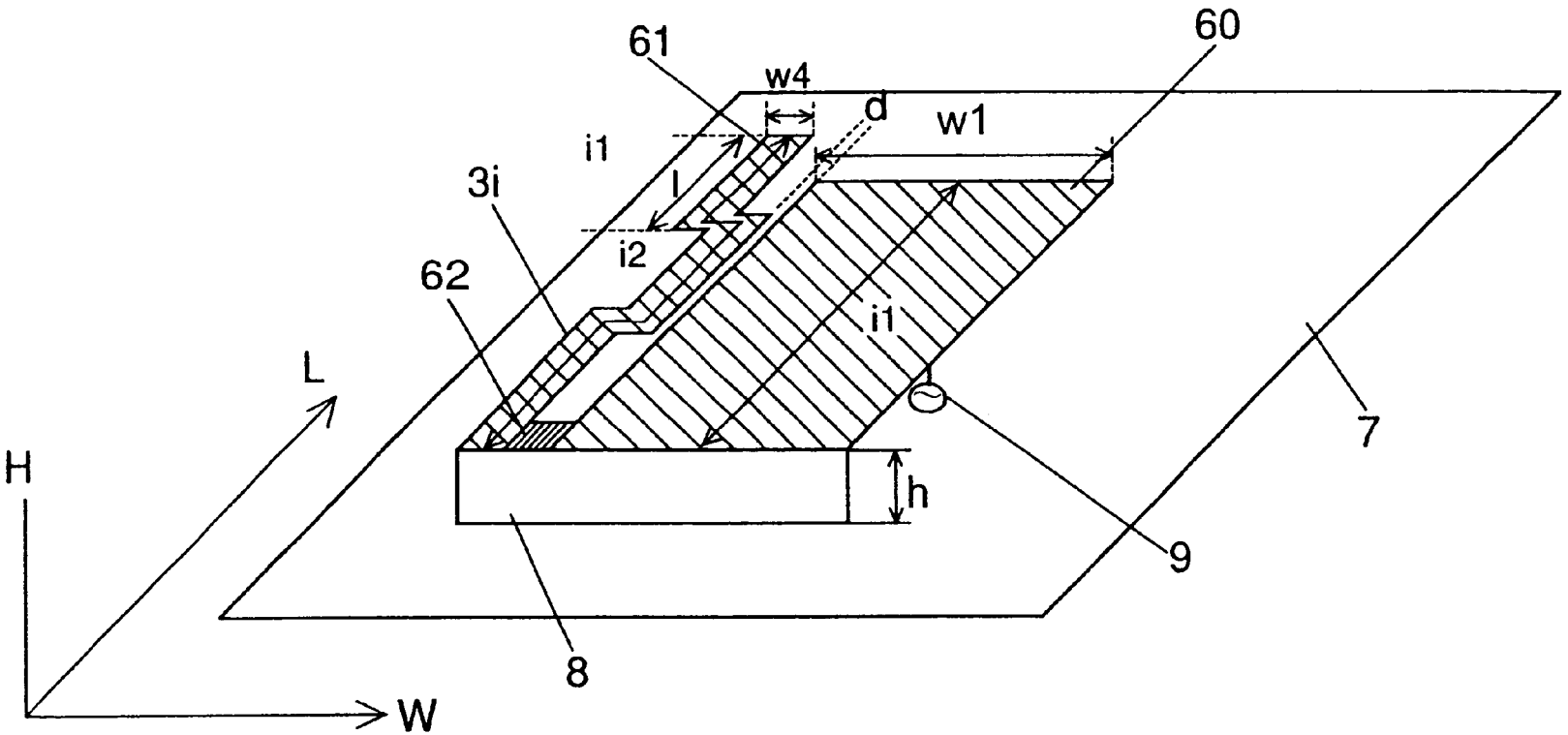
FIG. 7 is a perspective view of an antenna in accordance with an eighth exemplary embodiment of the present invention.

The eighth embodiment differs from the first one in a shape, number and arrangement of the radiator elements, and other points remain almost the same. Thus, only the difference will mainly be described hereinafter. FIG. 7 is a perspective view of the antenna in accordance with the eighth embodiment. In FIG. 7, radiator elements and couplers are mainly illustrated, and an antenna board as well as a spacer is not shown.

Elements, 60, 61 are made of the same material as elements 2, 3, 4 in the first embodiment, and the thickness of the elements remain the same. In order to transmit/receive a plurality of frequencies, one or more than one elements are provided to one frequency. Element 60 corresponds to high frequency $f_1$, and element 61 corresponds to low frequency $f_2$. In the eighth embodiment, two elements are prepared; however, a number of elements may be three or more than three.

Coupler 62 couples element 60 with element 61. Coupler's dimension and the way of forming the coupler are the same as those of couplers 5, 6 in the first embodiment.

Next, the electrical characteristics of the antenna will be described hereinafter. In FIG. 7, lengths i1 and i2 of radiator elements 60 and 61 correspond to guide wavelength $\lambda g1$, $\lambda g2$ of resonance frequencies $f_1$, $f_2$, respectively. Lengths i1, i2 and height 'h' of short-circuiting plate 8 are key factors for determining the resonance frequencies. Resonance frequency f, corresponding to element 60 is almost determined by the length (h+i1). In the same way, resonance frequency f2 ($f_1>f_2$) is almost determined by the length of (h+i2). When these values fall in the following. ranges, the antenna has given resonance frequencies $f_1$ and $f_2$.

| | |
|---|---|
| h, h1: | 0.5–3.0 inch |
| i1, i2: | $\lambda/100$–$3\lambda/8$ |

If the following relations are satisfied, the antenna can be thinner with excellent characteristics: 0.5 inch$\leqq$h$\leqq$3.0 inch, $\lambda/6 \leqq$(i1, i2)$\leqq \lambda/3$.

If the sum of element's length and the height of short-circuiting plate is about $\lambda/4$, the most excellent antenna characteristics can be obtained.

If the width of elements 60, 61, i.e. w1, w4 fall in the range of 0–$\lambda/4$, a highly efficient antenna can be achieved.

In this eighth embodiment, element 61 is formed by meander line as shown in FIG. 7. The dimensions thereof are, guide width w4 ranging $\lambda/50$–$\lambda/400$, interval of the elements 'd' ranging $\lambda/100$–$\lambda/400$, and element's width ranging $\lambda 10$–$\lambda/20$. As FIG. 7 illustrates, element 60 differs from element 61 in the guide length. Since element 61 employs the meander line, it can shorten the longitudinal length, and thus a long and narrow antenna is obtainable.

Exemplary Embodiment 9

Figure 8:
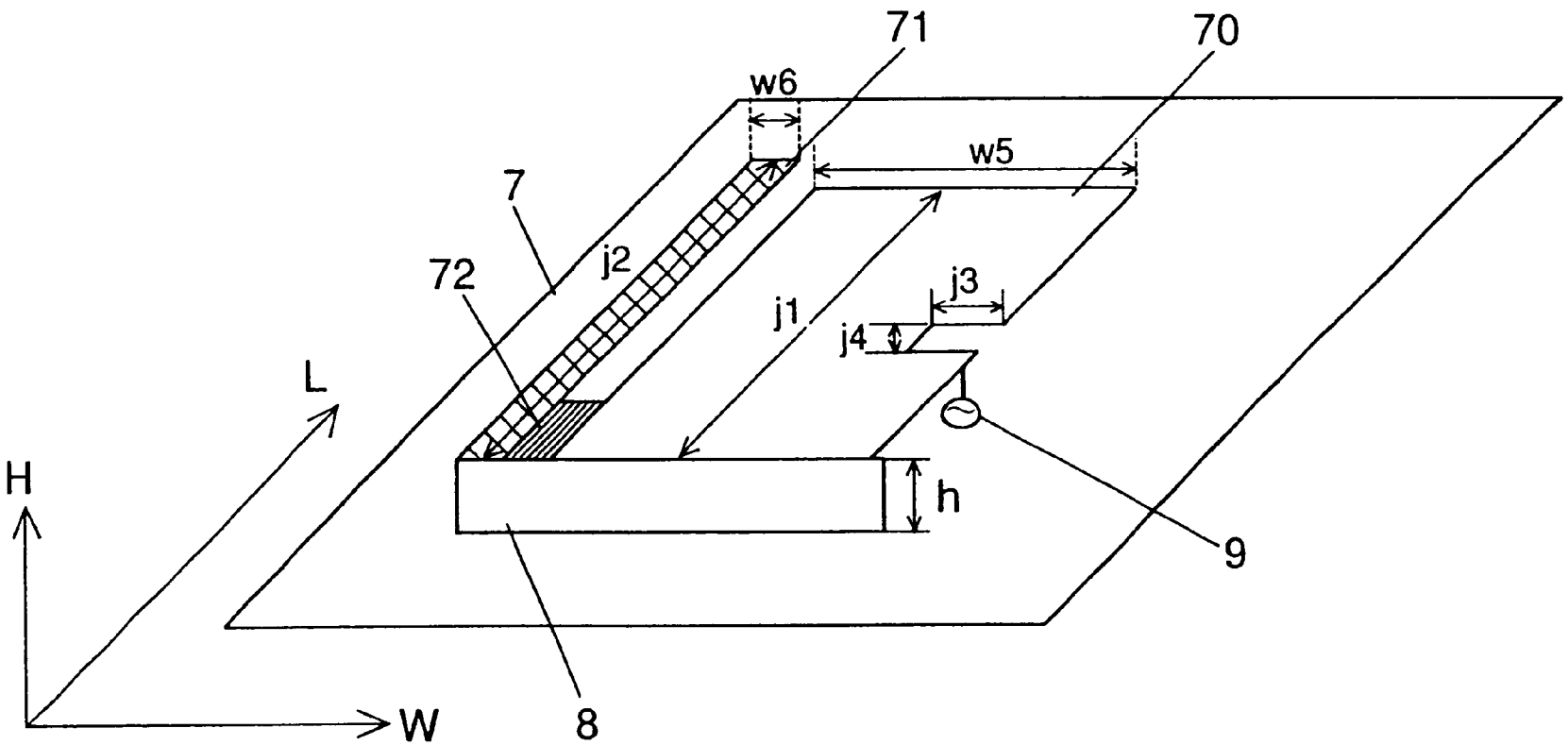
FIG. 8 is a perspective view of an antenna in accordance with a ninth exemplary embodiment of the present invention.

The ninth embodiment differs from the first one in a shape and arrangement of the radiator elements, and other points remain almost the same. Thus, only the difference will be described hereinafter. FIG. 8 is a perspective view of the antenna in accordance with the ninth embodiment. In FIG. 8, radiator elements and couplers are mainly illustrated, and an antenna board as well as a spacer is not shown.

Elements, 70, 71 are made of the same material as elements 2, 3, 4 in the first embodiment, and the thickness of the elements remain the same. In order to transmit/receive a plurality of frequencies, one or more than one elements are provided to one frequency. Element 70 corresponds to high frequency $f_1$, and element 71 corresponds to low frequency $f_2$. In the ninth embodiment, two elements are prepared; however, a number of elements may be three or more than three.

Coupler 72 couples element 70 with element 71. Coupler's dimension and the way of forming the coupler are the same as those of couplers 5, 6 in the first embodiment.

Next, the electrical characteristics of the antenna will be described hereinafter. In FIG. 8, lengths j1 and j2 of radiator elements 70 and 71 correspond to guide wavelength $\lambda g1$, $\lambda g2$ of resonance frequencies $f_1$, $f_2$, respectively. Lengths j1, j2 and height 'h' of short-circuiting plate 8 are key factors for determining the resonance frequency. Resonance frequency $f_1$ corresponding to element 70 is almost determined by the length (h+j1). In the same way, resonance frequency f2 is almost determined by the length of (h+j2). When these values fall in the following ranges, the antenna has given resonance frequencies $f_1$ and $f_2$.

| | |
|---|---|
| h, h1: | 0.5–3.0 inch |
| i1, i2: | λ/100–3λ/8 |

If the following relations are satisfied, the antenna can be thinner with excellent characteristics: 0.5 inch≦h≦3.0 inch, λ/6≦(j1, j2) ≦λ/3.

If the sum of element's length and the height of short-circuiting plate is about λ/4, the most excellent antenna characteristics can be obtained.

If the width of elements 70, 71, i.e. w5, w6 fall in the range of 0–λ/4, a highly efficient antenna can be achieved.

In the ninth embodiment, a slit is provided near the center of element 70. The dimensions of this slit are length=j3, and width=j4. This structure allows the resonance frequency f, to be lowered. In other words, with respect to the same frequency, the ninth embodiment can provide a smaller antenna than a case where antenna does not have the slit.

Exemplary Embodiment 10

Figure 9:
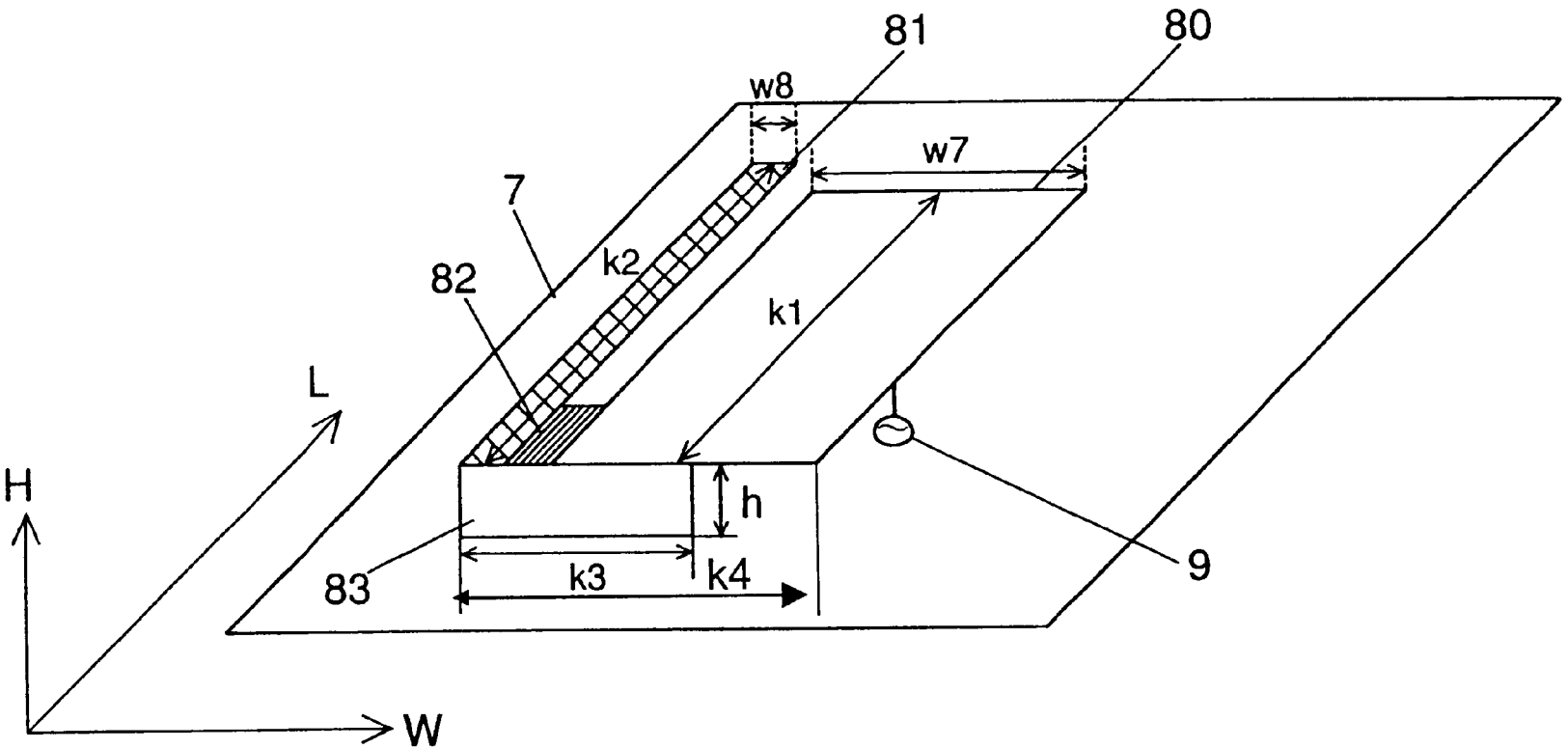
FIG. 9 is a perspective view of an antenna in accordance with a tenth exemplary embodiment of the present invention.

The tenth embodiment differs from the first one in a number, arrangement of the radiator elements and a shape of short-circuiting plate, and other points remain almost the same. Thus, only the difference will be described hereinafter. FIG. 9 is a perspective view of the antenna in accordance with the tenth embodiment. In FIG. 9, radiator elements and couplers are mainly illustrated, and an antenna board as well as a spacer is not shown.

Elements, 80, 81 are made of the same material as elements 2, 3, 4 in the first embodiment, and the thickness of the elements remain the same. In order to transmit/receive a plurality of frequencies, one or more than one elements are provided to one frequency. Element 80 corresponds to high frequency $f_1$, and element 81 corresponds to low frequency $f_2$.

Coupler 82 couples element 80 with element 81. Coupler's dimension and the way of forming the coupler are the same as those of couplers 5, 6 in the first embodiment.

Next, the electrical characteristics of the antenna will be described hereinafter. In FIG. 9, lengths k1 and k2 of radiator elements 80 and 81 correspond to guide wavelength λg1, λg2 of resonance frequencies $f_1$, $f_1$, respectively. The relation between antenna characteristics and the dimensions including lengths k1, k2, widths w7, w8 and the height 'h' of short-circuiting plate 8 remains the same as that in the ninth embodiment. In other words, setting the dimensions 'h', k1, k2 as same as those in the ninth embodiment produces a thinner antenna with excellent characteristics. Further, setting widths w7, w8 in the same way produces a highly efficient antenna.

In the ninth embodiment, length k3 (the length of contacting portion of short-circuiting plate 83 with the grounding plate) is shorter than length k4 (the length between the side end of element 81 and the side end of element 80). Adjusting length k3 can lower the resonance frequency of the antenna. As a result, with respect to the same frequency, the ninth embodiment can provide a smaller antenna than a case where an antenna does not have this shape of short-circuiting plate.

Exemplary Embodiment 11

Figure 10:
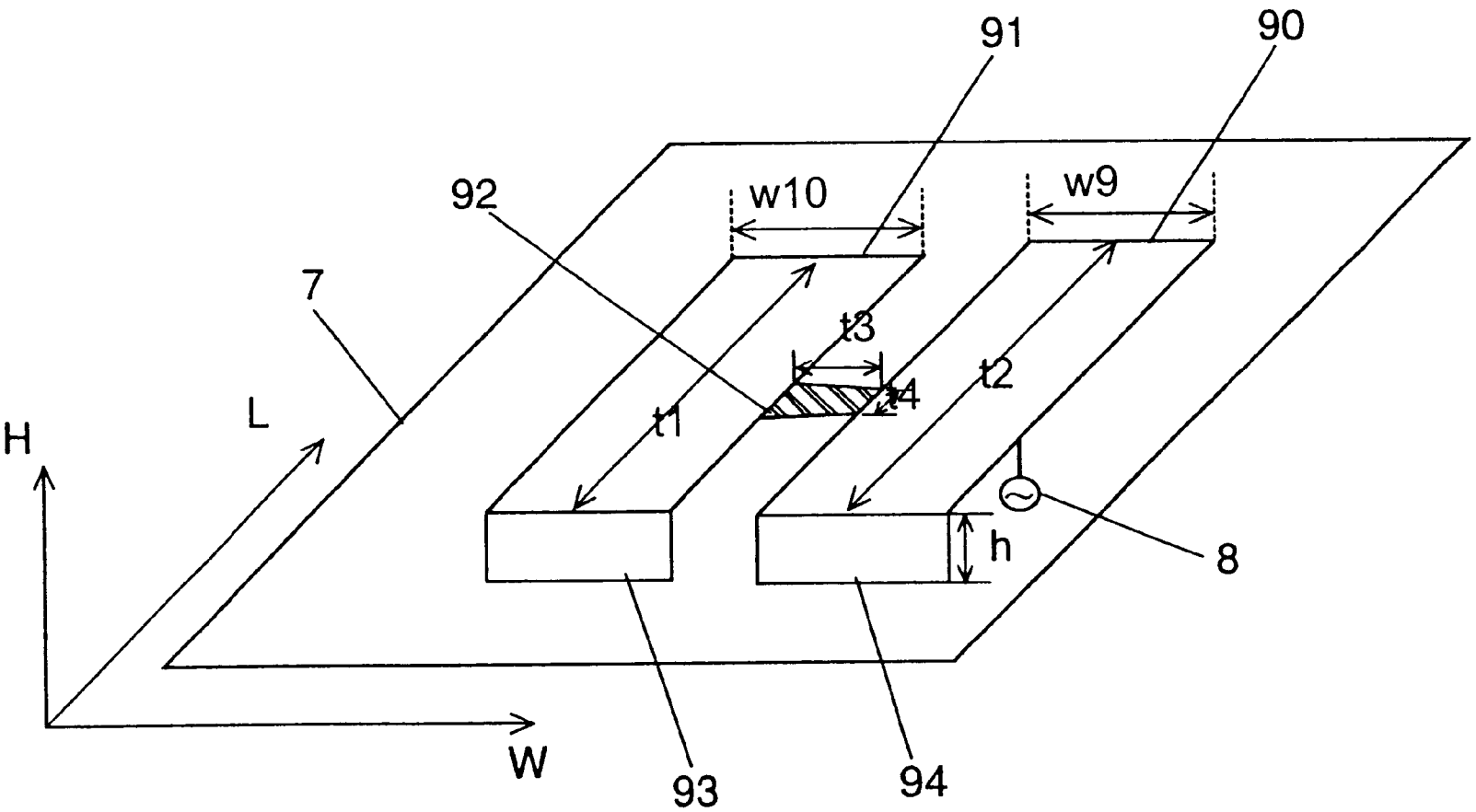
FIG. 10 is a perspective view of an antenna in accordance with an 11th exemplary embodiment of the present invention.

The 11th embodiment differs from the first one in a shape and arrangement of the radiator elements, and other points remain almost the same. Thus, only the difference will be described hereinafter. FIG. 10 is a perspective view of the antenna in accordance with the 11th embodiment. In FIG. 10, radiator elements and couplers are mainly illustrated, and an antenna board as well as a spacer is not shown.

Elements, 90, 91 are made of the same material and in the same way as elements 2, 3, 4 in the first embodiment, and the thickness of the elements remain the same. In order to transmit/receive a plurality of frequencies, one or more than one elements are provided to one frequency. Element 90 corresponds to high frequency $f_1$, and element 91 corresponds to low frequency $f_2$. In the 11th embodiment, two elements are prepared; however, a number of elements may be three or more than three.

Coupler 92 couples element 90 with element 91 electrically. In the 11th embodiment, coupler 92 is disposed at a certain distance in L direction from short-circuiting plates 93, 94. Plate 93 couples element 91 with grounding plate 7, and plate 94 couples element 90 with plate 7.

Coupler 92 preferably has the dimensions of length= 5–100 mm and width=10–50 mm for optimizing a coupled power.

Next, the electrical characteristics of the antenna will be described hereinafter. In FIG. 10, lengths t1 and t2 of radiator elements 90 and 91 correspond to guide wavelength λg1, λg2 of resonance frequencies $f_1$, $f_2$, respectively. The relation between antenna characteristics and the dimensions including lengths t1, t2, widths w9, w10 and the height 'h' of short-circuiting plate 93, 94 remains the same as that in the tenth embodiment. In other words, setting the dimensions 'h', t1, t2 as same as those in the tenth embodiment produces a thinner antenna with excellent characteristics. Further, setting widths w9, w10 in the same way produces a highly efficient antenna.

Length t3 and width t4 of the coupler are adjusted appropriately, so that current induced from element 90 to element 91 through coupler 92 is adjusted. As a result, the gain and frequency bandwidth characteristics of the antenna can be adjusted. Meanwhile, element 90 is fed a power to, while element 91 is not fed a power to directly.

Exemplary Embodiment 12

Figure 11:
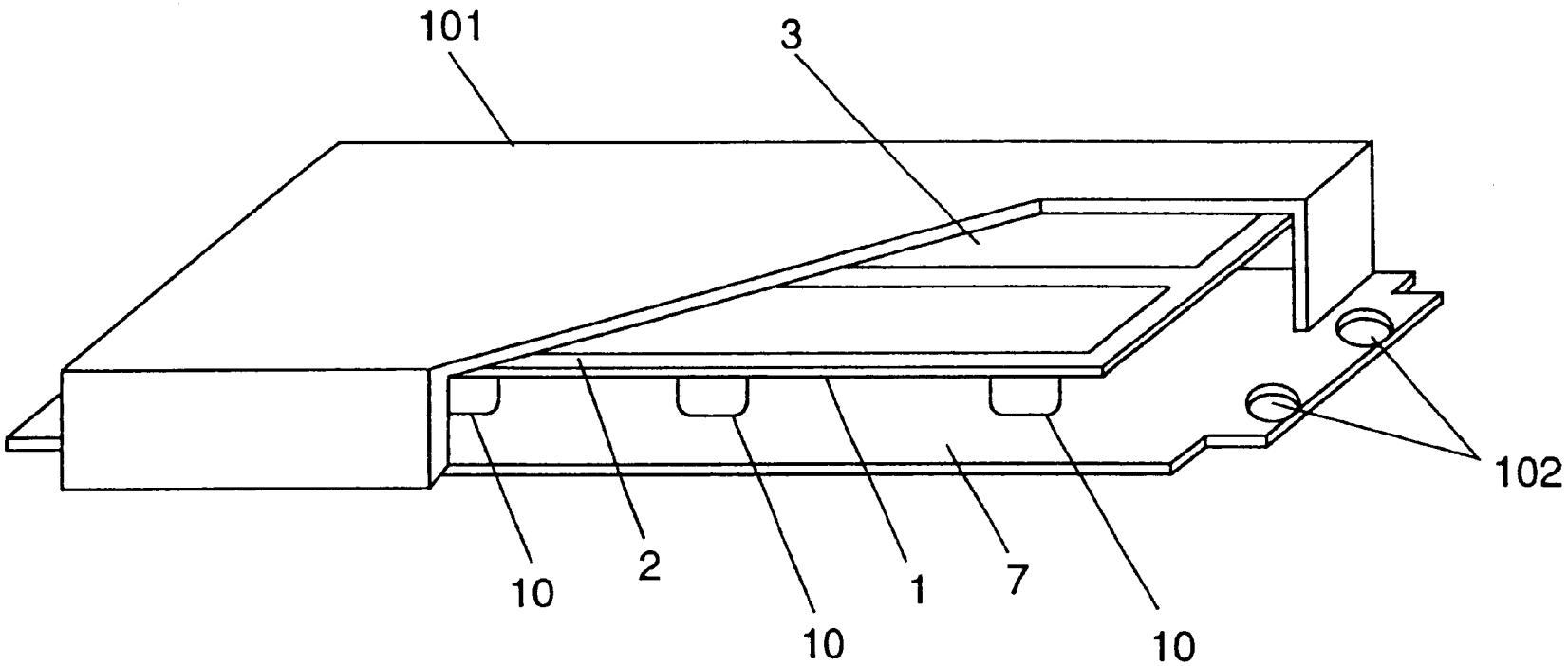
FIG. 11 is a perspective view of an antenna in accordance with a 12th exemplary embodiment of the present invention.

FIG. 11 is a perspective view of the antenna in accordance with the 11th embodiment, and illustrates that the antenna is disposed outside a car or a container. The like members shown in FIG. 1 of the first embodiment are used in the 12th embodiment with the like reference marks. In this embodiment, any one of antennas used in embodiments 1 through 11 is used. Each member of the antenna will be described independently hereinafter.

Spacer 10 is made of an elastic material such as rubber or resin, and inserted between antenna board 1 and grounding plate 7 as a support member to maintain exactly the height 'h' therebetween. Spacer 10 is disposed at a space on antenna board 1 where cooper foil of elements 2 and 3 is not formed, so that change of an actual dielectric constant of the space between board 1 and grounding plate 7 is minimized. In other words, influence to antenna characteristics can be minimized. A recess is formed to at least one of antenna board 1 or grounding plate 7 so that spacer 10 is fit into the recess (not shown in FIG. 11). As a result, spacer 10 is not moved. Spacer 10 is disposed closely to the copper foil of elements 2, 3 and 4, whereby only little changes in the antenna characteristics can be expected. Thus a highly reliable antenna is obtainable. If spacer 10 is preferably fixed, a protrusion is formed on at least one of grounding plate 7 or antenna board 1, and a recess is formed to spacer 10 for engaging the protrusion. Another method of fixing spacer 10 is to punch a through hole on at least one of rounding plate 7 or antenna board 1 for screwing down spacer 10. In this embodiment, spacer 10 is disposed between board 1 and plate 7; however, another spacer can be added between plate 7 and radome 101. In this case, the height of spacer 10 between board 1 and plate 7 is set higher than the another spacer between plate 7 and radome 101, so that antenna board 1 is placed farther from plate 7. As a result, the antenna characteristic is improved. On the same grounds, when a plurality of spacers are not necessarily, antenna board 1 is preferably disposed closer to radome 101 than grounding plate 7. Spacer 10 preferably changes its elasticity depending on its face contacting the surface of antenna board 1 or the back-face thereof because copper foil is formed on the surface, and not on the back-face. The spacer contacting the surface and having greater elasticity is used, and the spacer contacting the back-face and having smaller elasticity is used, then the radiator elements are prevented from being damaged by the spacers when vibration or shock moves antenna board 1. On the same grounds, when antenna board 1 contacts directly radome 101, it is preferable that the surface of board 1 does not face to radome 101.

Radome 101 is disposed to cover antenna board 1 where various circuits are formed, and it is made of weather-proof resin. Radome 101 and grounding plate 7 accommodate antenna board 1 and spacer 10. Radome 101 is fixed to plate 7 with bonding material or screws. Waterproof seal or a 0-ring is put in the boundary between radome 101 and plate 7, then inert gas such as dry air or gaseous nitrogen is sealed therein, so that water or moisture will not enter the inside of the antenna. As a result, the antenna is free from dew, and is prevented from being degraded or malfunction.

Mounting holes 102 are provided on the end of grounding plate 7. These holes allow the antenna to be mounted to an object body (car or container) with grounding plate 7 as a bottom face. Comparing with a case where a separate antenna mounting member is used for mounting an antenna, the lower height of the antenna in accordance with the 12th embodiment from the object body can be expected. Mounting holes 102 may be provided in the longitudinal direction instead of the short side direction, or can be provided in both the directions. Grounding plate can be bonded to a metal housing of the object body with conductive bonding member instead of providing mounting holes 102.

Figure 12:
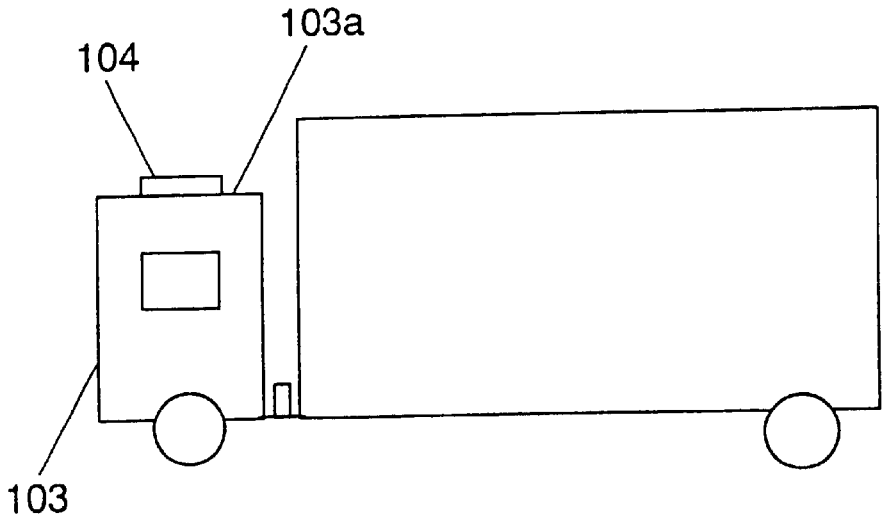
FIG. 12 is a plan view illustrating a mounting of the antenna to a car in the 12th embodiment of the present invention.
Figure 13:
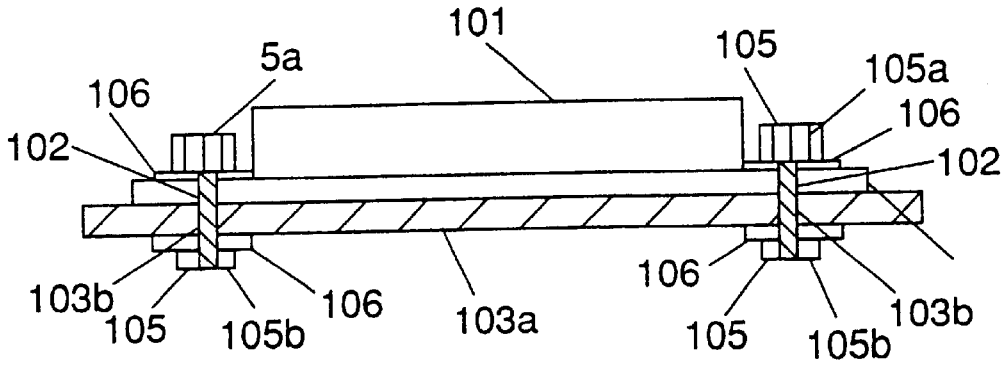
FIG. 13 is a cross section illustrating a mounted section of the antenna in the 12th embodiment of the present invention.

The way of mounting antenna board 1 will be described hereinafter. Antenna board 1 is pressed and fixed to the inner face of radome 101 by the elasticity of spacer 10 disposed between board 1 and plate 7. The inner face of radome 101 is so designed to be approximately parallel with grounding plate 7. Board 1 and spacer 10 have been disposed at given places with respect to plate 7, then radome 101 is pressed and fixed to plate 7. Spacer 10, antenna board 1, and grounding plate 7 are therefore simultaneously but indirectly fixed with each other. As a result, a number of steps for assembling and mounting the antenna can be reduced, and the productivity is improved. This simple structure allows board 1 to keep flatness, thus the clearance between plate 7 and board 1 can be kept approximately constant. As a result, the antenna of excellent characteristics and high productivity are obtainable. Meanwhile this clearance substantially influences the antenna characteristics. Radome 101 is fixed to plate 7 with bolts and nuts using through holes provided on the end of radome 101 and corresponding to through holes 102. There is another way to fix radome to plate 7, i.e., through holes are provided to radome 101, and screw holes are provided to plate 7. When screw holes are provided, it is necessary to watch that burrs should not appear on plate 7. Without the burrs, the height of the antenna would not be raised, and grounding plate 7, which is a mounting face to the object body, keeps its flatness. FIG. 12 illustrates that antenna 104 used in the 12th embodiment is mounted to metal housing 103*a* of truck body 103. FIG. 13 details the mounting section. Through holes 103*b* are provided on metal housing 103*a*, bolts 105*a* are inserted through holes 102, 103*b*, and tightened with nuts 105*b*, whereby antenna 104 is mounted to truck body 103. It is preferable that plate 7 contact housing 103*a* directly. In general, when an antenna is placed close to a metal face, the original antenna characteristics are degraded because the metal face affects the antenna, so that the antenna impedance changes and impedance miss-matching with the feed line occurs. As a result, return loss increases. In order to prevent this problem, grounding plate 7 of antenna 104 is exposed outside and metal-housing 103*a* contacts the exposed plate directly. If plate 7 is bonded to housing 103*a* with conductive bonding material, antenna 104 can be mounted to truck body 103 with ease. In this case, mounting holes 102 are not needed, thus the structure of plate 7 becomes simple. As a result, the antenna of a lower cost, easy-to-assemble, and easy-to-mount is obtainable. Between antenna 104 and truck body 103, there may be a pad for protecting the antenna from vibration and shock.

Bolts 105*a* and nuts 105*b* are made of metal. This is preferable because they positively make plate 7 electrically contact metal housing 103*a*. This is effective particularly when a pad is put between antenna 104 and truck body 103, or when antenna 104 does not directly and electrically contact truck body 103. Water-proof washers made of elastic material are preferably used because they prevent water or moisture from entering into the object along bolt 105*a*.

Figure 14:
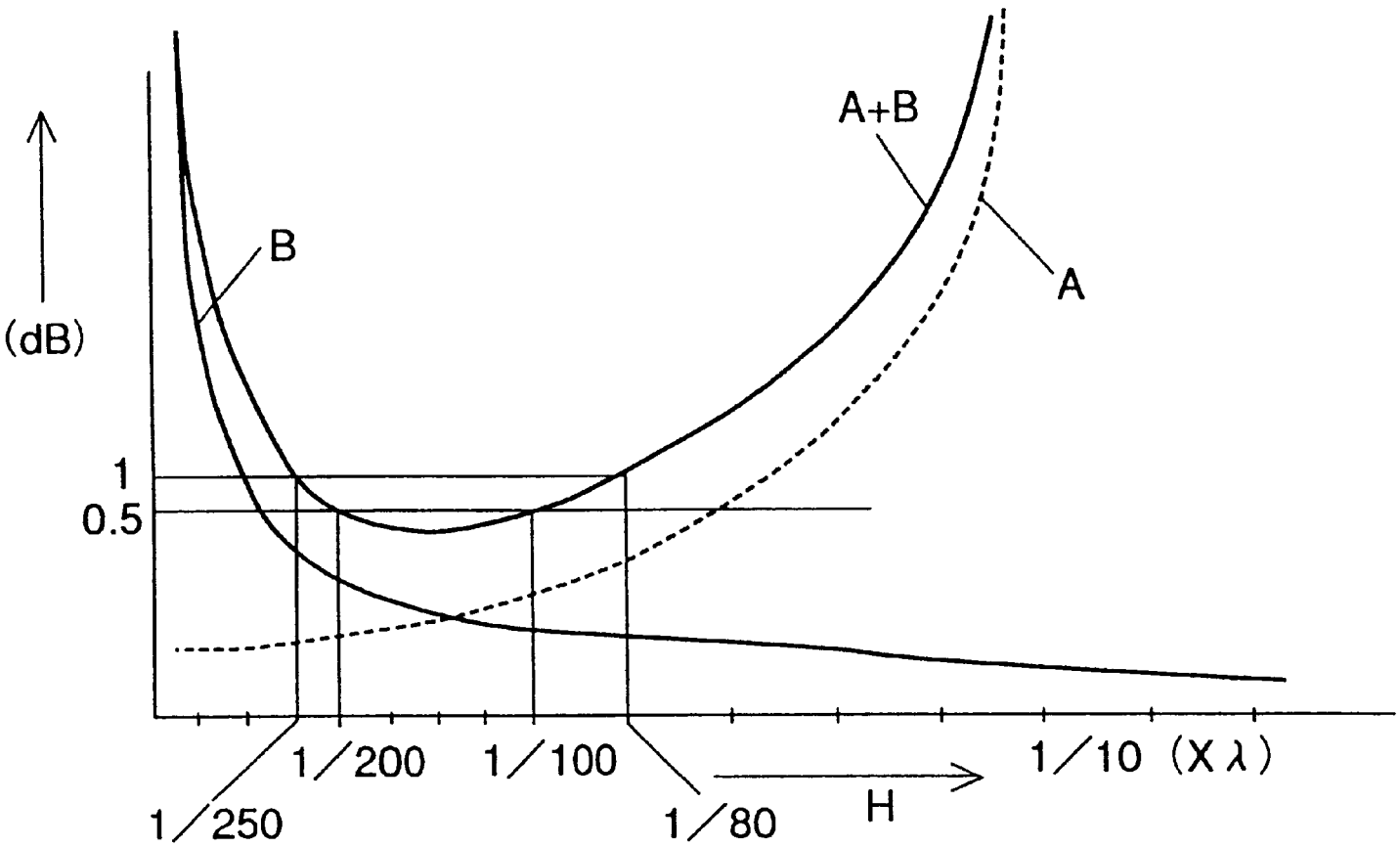
FIG. 14 shows a relation of a distance between the radiator elements and the grounding plate vs. antenna loss in the 12th embodiment of the present invention.
Figure 15:
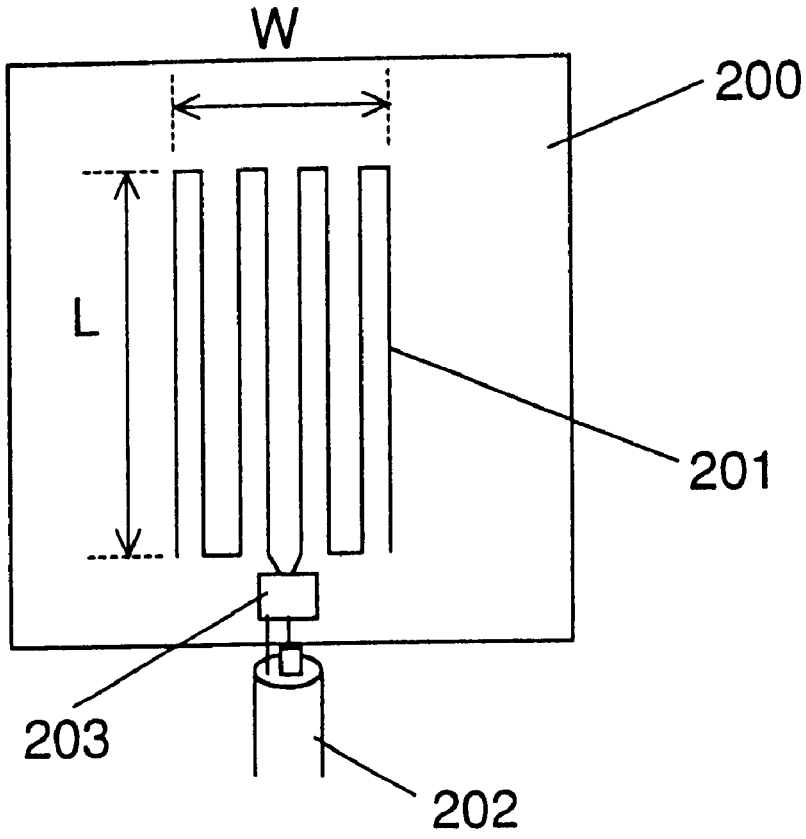
FIG. 15 Prior Art
FIG. 15 is a plan view of a conventional antenna.
Figure 16:
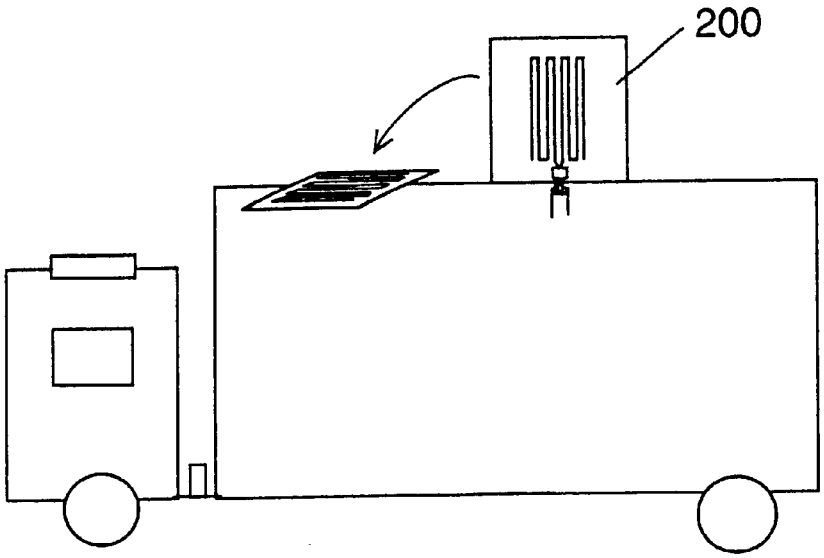
FIG. 16 Prior Art
FIG. 16 is a lateral view of the conventional antenna mounted to a car.
Figure 17:
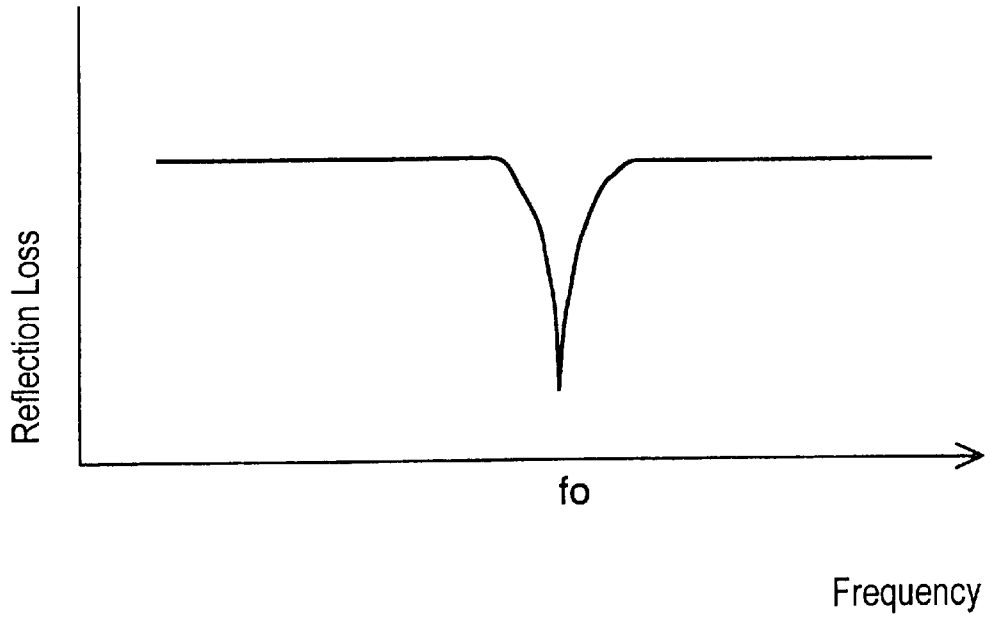
FIG. 17 Prior Art
FIG. 17 shows a relation of return loss vs. frequency of the conventional antenna.
Figure 18:
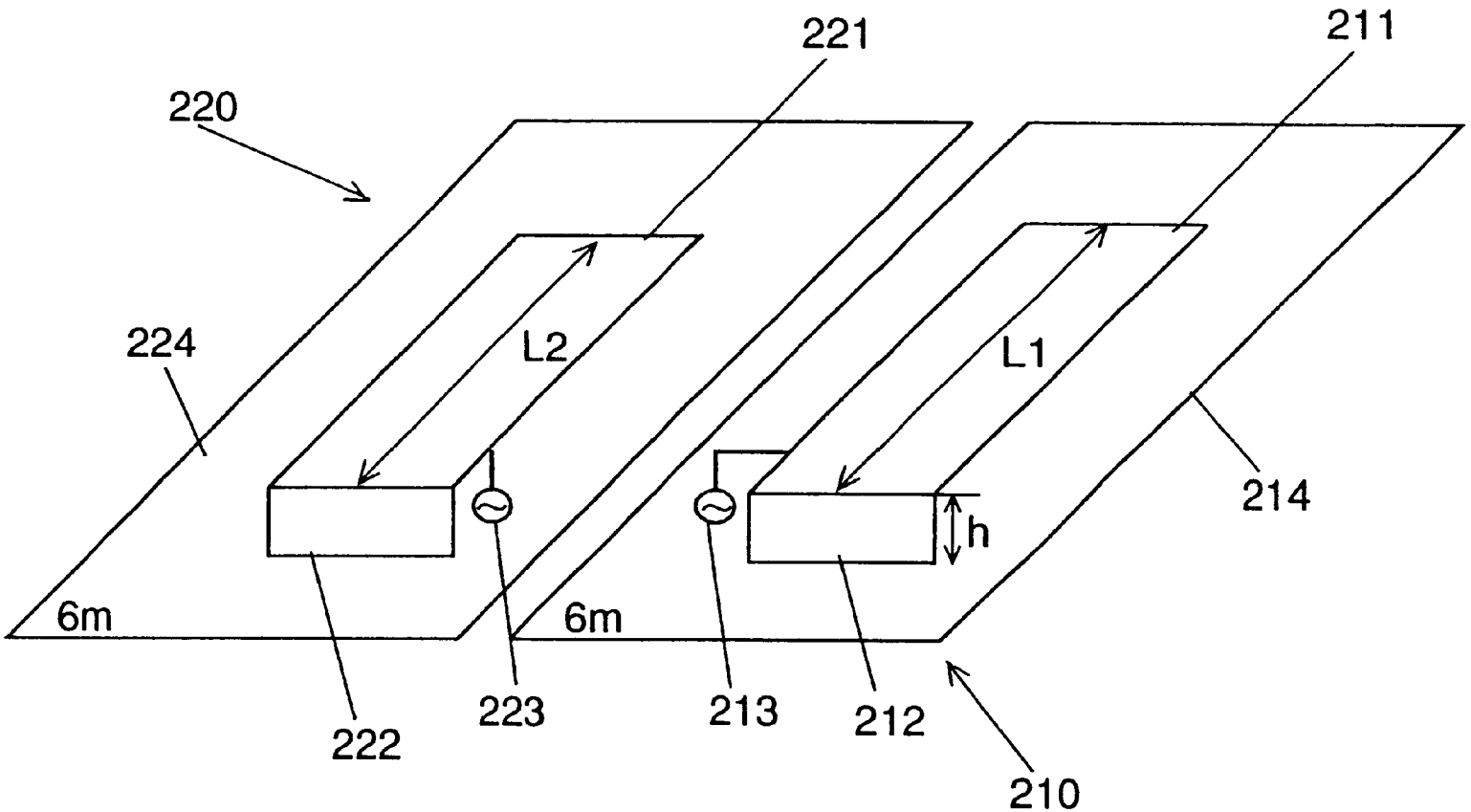
FIG. 18 Prior Art
FIG. 18 is a perspective view of another conventional antenna.

The height of antenna 104 mounted to metal housing 103*a* will be described hereinafter. FIG. 14 illustrates a relation of antenna loss vs. the distance between the radiator element and the grounding plate. In the antenna placed close to grounding plate 7, when the width of element 2 stays constant, conductor loss B is inversely proportion to clearance 'h' between plate 7 and radiator element 2 while radiation loss A is proportionate to clearance 'h'. Receiving sensitivity of the antenna is actually changed by external factors under the working condition; however, at least the sum of conductor loss B and radiation loss A, i.e., (A+B) that is inner loss, should be minimized for maintaining the receiving sensitivity in good condition. Allowable inner loss is preferably not more than 1 dB in general, and 0.5 dB for the satellite communications where weak radio waves are transmitted or received. Therefore, when FIG. 14 is referred, clearance 'h' should fall in the following ranges: $1/250 \leqq h/\lambda 1/80$, or preferably $1/200 \leqq h/1/100$ For instance, when this antenna is used in ORBCOMM system (2000 mm$\leqq\lambda$2190 mm), clearance 'h' should be 8.76 mm$\leqq$h $\leqq$25 mm and preferably 10.95 mm$\leqq$h$\leqq$20 mm. Since the height of antenna 104 is so small that the antenna can be mounted with ease to a container which is supposed to be stacked up. The clearance between the stacked containers is actually as low as 1–2 inches. The thickness of the antenna in accordance with the 12th embodiment is within this range, and the container mounted with the antenna can therefore be stacked up. Further, grounding plate 7 can be electrically contacted to the metal housing of the container, and the changes of the antenna impedance can thus be minimized even if the containers are stacked up on the antenna 104.

What is claimed is:

1. An antenna for transmitting and receiving a radio wave of which wavelength is λ, said antenna comprising:

a board;

a first radiator element disposed distantly from said board, a length of said first radiator element in a first direction ranging λ/8–3λ/8, said first radiator element having a slit formed thereon at an end of said first radiator element in the first direction, a length of the slit ranging λ/50–λ/15;

a second radiator element disposed distantly from said board and also distantly from said first radiator element in a second direction, a length of said second radiator element in the first direction ranging λ/8–3λ/8; and a feeding section disposed at the slit formed on said first radiator element, said feeding section being operable to feed said first radiator element with power, wherein a distance between said board and said first radiator element ranges 0.5–3 inches;

wherein a distance between said board and said second radiator element ranges 0.5–3 inches.

2. An antenna as claimed in claim 1, wherein said board, said first radiator element, and said second radiator element are disposed approximately parallel with each other.

3. An antenna as claimed in claim 1, wherein the length of said first radiator element in the first direction differs from the length of said second radiator element in the first direction.

4. An antenna as claimed in claim 1, wherein said first radiator element differs from said second radiator element in a resonance frequency.

5. An antenna as claimed in claim 1, further comprising a coupler operable to electrically couple said first radiator element with said second radiator clement.

6. An antenna as claimed in claim 5, wherein said feeding section disposed in said first radiator element is operable to feed said first radiator element with power and to feed said second radiator element with power via said first radiator element as well as said coupler.

7. An antenna as claimed in claim 1, wherein a distance between said first radiator element and said second radiator element in the second direction ranges 10–40 mm.

8. An antenna as claimed in claim 1, wherein a thickness of said first radiator element in a third direction ranges 18 μm–3 mm, and a thickness of said second radiator element in the third direction ranges 18 μm–3 mm.

9. An antenna as claimed in claim 1, wherein an area (S1) of said first radiator element and an area (S2) of said second radiator element satisfy a relation of $1/30 \leqq S1/S2 \leqq 1/2$.

10. An antenna as claimed in claim 1, wherein said first radiator element, said second radiator element, and said coupler are formed on a common plane and made of a same material.

11. An antenna as claimed in claim 1, wherein a distance between said board and said first radiator element is shorter than a distance between said board and said second radiator element.

12. An antenna as claimed in claim 1, wherein at least one of said first radiator element and said second radiator element is formed in meander line.

13. An antenna for transmitting and receiving a radio wave of which wavelength is λ, said antenna comprising:

a board;

a first radiator element disposed distantly from said board, a length of said first radiator element in a first direction ranging λ/8–3λ/8;

a second radiator element disposed distantly from said board and also distantly from said first radiator element in a second direction, a length of said second radiator element in the first direction ranging λ/8–3λ/8; and a feeding section disposed in a slit formed on said first radiator element near a center in the first direction of said first radiator element, wherein a distance between said board and said first radiator element ranges 0.5–3 inches; and wherein a distance between said board and said second radiator element ranges 0.5–3 inches.

14. An antenna for transmitting and receiving a radio wave of which wavelength is λ, said antenna comprising:

a board;

a first radiator element disposed distantly from said board, a length of said first radiator element in a first direction ranging λ/8–3λ/8, said first radiator element having a slit formed thereon at an end of said first radiator element in the first direction, said slit being formed from a side of said first short-circuiting plate;

a second radiator element disposed distantly from said board and having a different antenna characteristic from said first radiator element, a length of said second radiator element in the first direction ranging λ/100–3λ/8;

a first short-circuiting plate operable to electrically couple said board with said first radiator element, and having a height of 0.5–3 inch;

a second short-circuiting plate operable to electrically couple said board with said second radiator element, and having a height of 0.5–3 inch; and a feeding section disposed at the slit formed on said first radiator element, said feeding section being operable to feed said first radiator element with power, wherein a sum of the length of said first radiator element in the first direction and the height of said first short-circuiting plate ranges λ/8–3λ/8, and a sum of the length of said second radiator element in the first direction and the height of said second short-circuiting plate ranges λ/8–3λ/8.

15. An antenna as claimed in claim 14, wherein a length of the slit ranges λ/50–λ/15.

16. An antenna as claimed in claim 14, further comprising a coupler operable to electrically couple said first radiator element with said second radiator element, wherein a length of said coupler in a second direction ranges 10–50 mm, and a length of said coupler in the first direction ranges 5–100 mm.

17. An antenna as claimed in claim 14, wherein said first short-circuiting plate and said second short-circuiting plate are formed of a common plate-shaped material.

* * * * *